United States Patent [19]

Karpisek

[11] 4,053,079

[45] Oct. 11, 1977

[54] PALLET CAGES

[76] Inventor: Ladislav Stephan Karpisek, 86 Woodfield Blvd., Caringbah, N.S.W., Australia

[21] Appl. No.: 748,552

[22] Filed: Dec. 8, 1976

[30] Foreign Application Priority Data

| | | |
|---|---|---|
| Dec. 10, 1975 | Australia | 4240/75 |
| Mar. 22, 1976 | Australia | 5291/76 |
| Apr. 28, 1976 | Australia | 5724/76 |
| Nov. 3, 1976 | Australia | 8006/76 |

[51] Int. Cl.[2] ..... B65D 9/12; B65D 7/00; B65D 7/20

[52] U.S. Cl. ..... 217/43 A; 220/1.5; 220/4 F; 220/19

[58] Field of Search ..... 217/43 R, 43 A, 12 R; 220/19, 4 F, 1.5

[56] References Cited

U.S. PATENT DOCUMENTS

| | | | |
|---|---|---|---|
| 2,975,929 | 3/1961 | Sjöblom | 220/1.5 X |
| 3,348,723 | 10/1967 | Wilson | 220/19 X |
| 3,392,863 | 7/1968 | Jennens | 217/12 R |
| 3,888,379 | 6/1975 | Folberth | 220/1.5 X |

*Primary Examiner*—William Price
*Assistant Examiner*—Steven M. Pollard
*Attorney, Agent, or Firm*—Emory L. Groff, Jr.

[57] ABSTRACT

Pallet cages to couple to a pallet and enclose goods stacked on the pallet, each cage comprising four panels, two locking and two hinged. The locking panels having clips which by manipulation of the locking panel are engageable under battens of the pallet to prevent removal of the locking panel unless said manipulation is reinacted. Each locking panel is hingedly connected to a hinged panel and adjacent portions of the hinged and locking panels of an assembled cage having interengageable catch means to retain the pallet cage unified as a four sided enclosure.

8 Claims, 27 Drawing Figures

FIG. 9
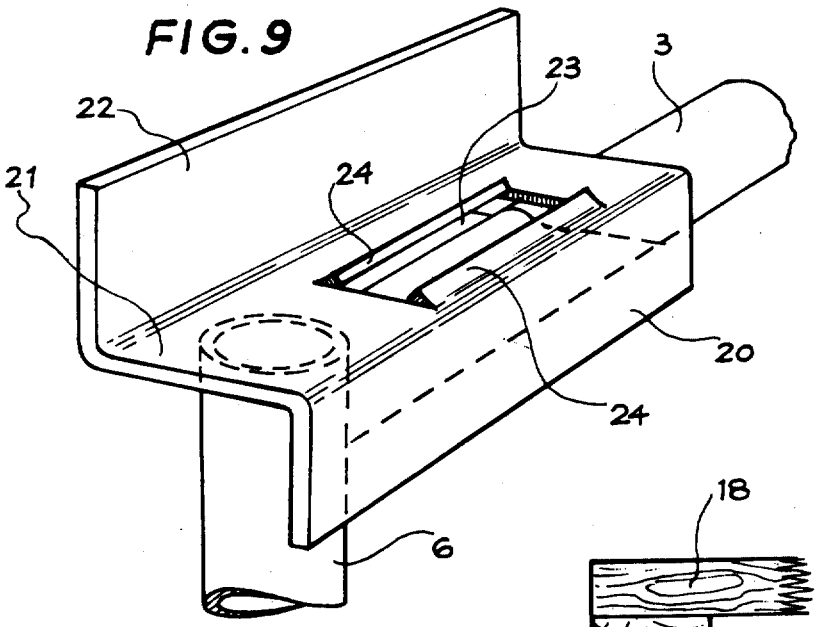
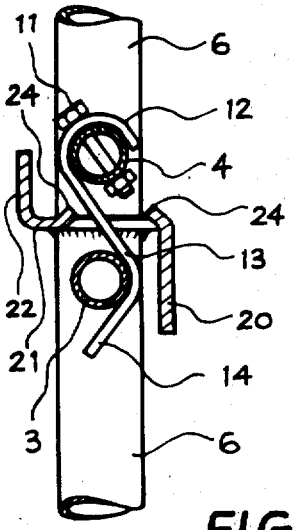
FIG. 10
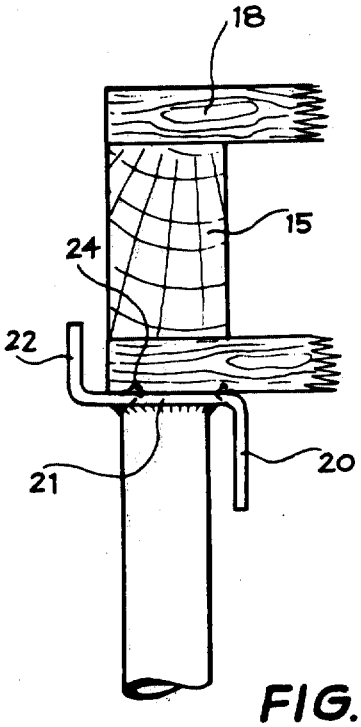
FIG. 11

PALLET CAGES

This invention relates to enclosures for goods carrying pallets, known in the trade as pallet cages.

Pallet cages as known hitherto, see for example Australian Pat. No. 432,748 have proved the utility of such devices but have not been designed so as to achieve their maximum usefulness. Known pallet cages as most commonly used today comprise two sections, each of two panels permanently hinged together, adapted to clip exteriorly over the outer long edges of the battens fixed to bearers, the battens making up the load carrying surface of the pallet and the free ends of the respective sections interlock to hold the cage in embracing relationship with the pallet. This arrangement means that the cage must be loaded and unloaded from above because to release one corner interlock to gain access to the load would be to release the restraint whereby the clips are retained in engagement with the battens. Consequently, if the load was pressing on the cage panels they would fall away outwardly from the pallet thereby releasing the load and the cage would collapse onto the ground.

Another drawback of the most commonly used pallet cage is that in order to extend the cage upwardly, by superimposing a second cage on the first cage, clips normally used to mount a cage on the pallet battens have to be removed from the second cage, stored for future use elsewhere, and mounting spikes have to be inserted in diagonally opposite tubular posts (forming the uprights of panels) of the second cage and these spikes are slid into corresponding tubular corner posts of the first cage. Such an arrangement calls for accurate alignment of the second cage relative to the first in order to achieve engagement of the spikes. If by mischance the spikes become bent, as can happen, in use, the removal of one cage from the other is a job of major proportions. These and a number of other operational problems render known pallet cages less than totally satisfactory.

The present invention overcomes both of the foregoing problems and other problems, not detailed above, whilst at the same time providing an extremely versatile cage with operational advantages allowing the use of such cages to be greatly expanded.

Before describing the pallet cage of the invention in detail it is to be noted that pallets are made to international standards of size and shape. Accordingly, it is possible to manufacture equipment to interlock with pallet components, whilst observing acceptable manufacturing tolerances, with full confidence that such equipment will fit all pallets of the size for which the cage is designed.

Pallets are universally made up of three rectangular section bearers with three battens located transversely of the bearers and fixed thereto respectively at the ends of the bearers and at midlength. These battens are the pallet supporting battens. Parallel to the support battens other and more numerous load bearing battens are fixed to the edges of the bearers opposite those to which the pallet supporting battens are fixed. The two outermost load bearing battens are wide battens (6 inches wide) and are at a set spacing apart and the intermediate load bearing battens are of a predetermined (lesser) width and are at a set spacing apart. For convenience the 6 inch battens will hereinafter be called "edge battens" and the load bearing other battens adjacent thereto will be called the "intermediate battens".

The present invention provides for a goods pallet comprising at least two parallel bearers with battens fixed to opposite top and bottom edges of the bearers and lying transverse to the bearers, the battens fixed to the bottom bearer edges being pallet support battens and the battens fixed to the top bearer edges being load support battens with two of those battens being parallel cage securing battens; a substantially rectangular pallet cage locking panel comprising a pair of uprights joined by top and bottom rails, a pair of clips on the bottom rail each clip comprising a leg with a hooked end, the clip legs extend in the same direction away from the panel and the hooked ends extend in opposite directions from outer edges of the legs, the spacing between the hooked end of the clips and the rail bottom in a direction parallel to the plane of the panel being not less than the thickness of the cage securing battens, the distance between the outer edges of the legs being not greater than the distance between the cage securing battens, and the overall distance between the ends of hooked ends of the clips exceeding the distance between the cage securing battens but not exceeding the diagonal distance between the intersections of the cage securing battens with adjacent bearers.

The invention is described in several embodiments with reference to the drawings in which FIG. 1 is a perspective view of a pallet cage section being an assembly of a locking panel to which is hingedly connected a door panel;

FIG. 9 is a perspective view showing another form of bracket for engaging a clip to mount one cage section on another;

FIG. 10 is a view similar to FIG. 5 showing the use of the bracket of FIG. 9;

FIG. 11 is a view showing how the bracket of FIG. 10 is used to position a pallet stacked on a pallet cage;

Figure 1:
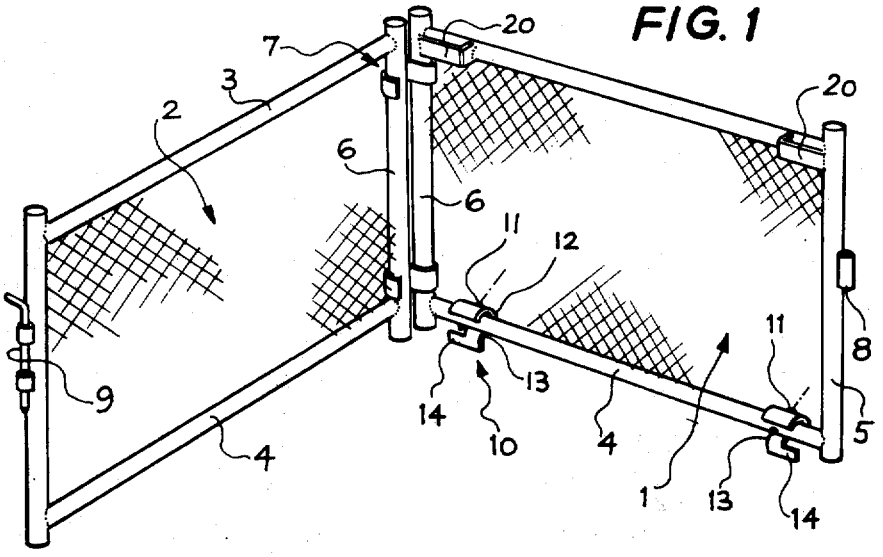

From FIG. 1 each cage section is a pair of panels, a locking panel 1 and a door panel 2. Each panel has a top rail 3 and a bottom rail 4 and uprights 5 and 6. The uprights 6 are hingedly connected together by hinge means 7 in a simple manner as shown and the upright 5 of panel 1 has first locking means 8 (a sleeve) and upright 5 of the door 2 has co-operating locking means 9 (a bolt).

Two hooked clips 10 are removably secured by bolts 11 to the rail 4 of panel 1. Each clip has a curled body part 12, a leg 13 and a hook portion 14 offset from the plane of the leg 13. The clips 10 are right and left hand and portion 14 extends towards the uprights 5 and 6.

Figure 2:
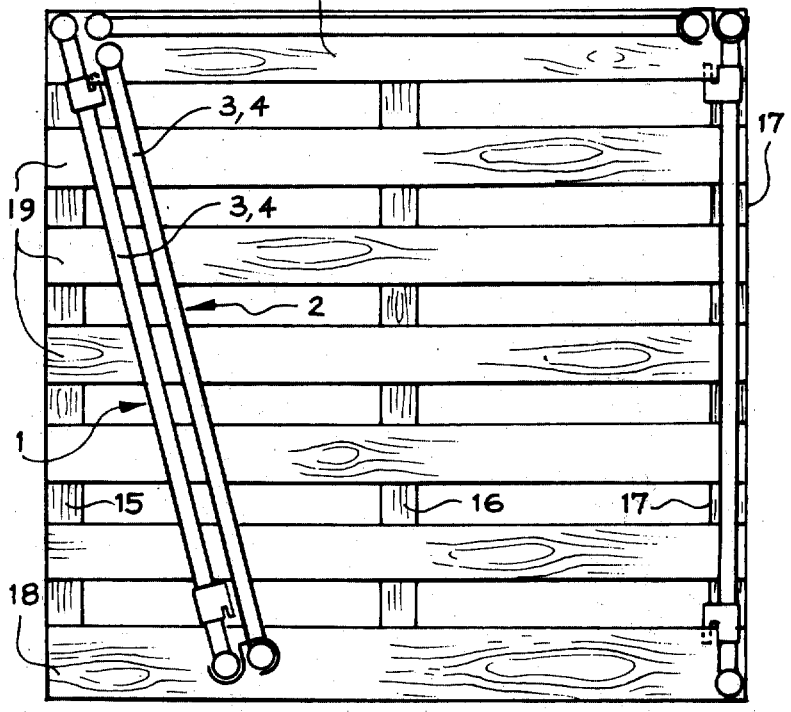
FIG. 2 is a view showing the manner of mounting an assembly as shown in FIG. 1 on a pallet.
Figure 3:
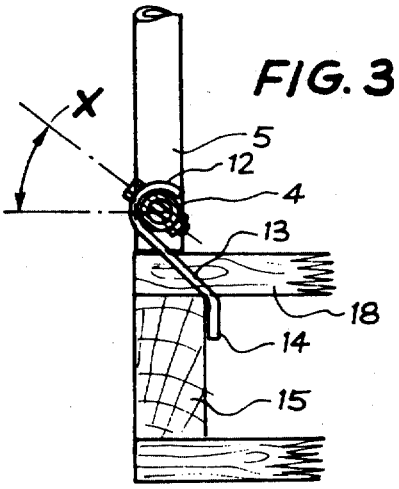
FIG. 3 is fragmentary view showing how a locking panel engages the battens of a pallet.
Figure 4:
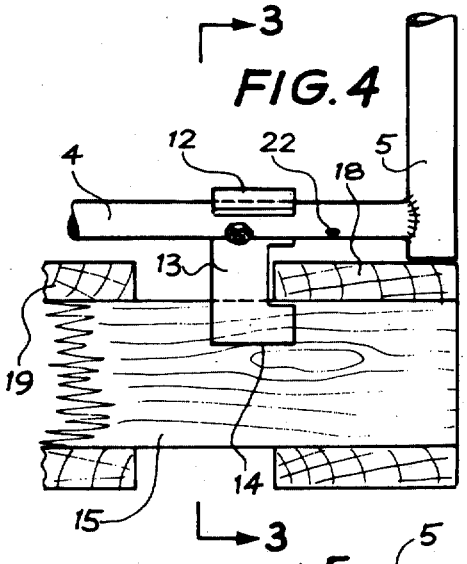
FIG. 4 is a view similar to FIG. 3 from another direction.

To mount a section on a pallet the operation is as shown in FIG. 2. The spacing of the clip legs 13 and the length of hooks 14 is such that when the rail 4 is angled to the bearer 15 the hooks 14 will slip between the edge of battens 18 (the cage securing battens) and the adjacent intermediate battens 19. By moving the section as shown by the arrow till the rails 3 and 4 lie parallel with the bearer 15 the hooks 14 will move under the battens 18 where they prevent the section from being lifted vertically off the pallet or from falling outwardly off the pallet, see FIGS. 3 and 4. Another panel is similarly mounted over bearer 17. The intermediate bearer is numbered 16. With the two sections mounted as described the doors 2 can be swung out to align items 8 and 9 which are engaged to form a closed cage.

It follows that if door 2 is open the panels 1 cannot fall away outwardly as was the case with the doors of the prior known cage.

Figure 5:
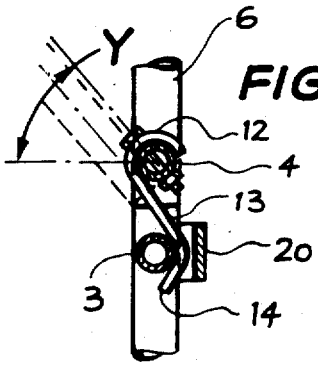
FIG. 5 is a view showing how one cage section is coupled to and superimposed on another cage section.
Figure 6:
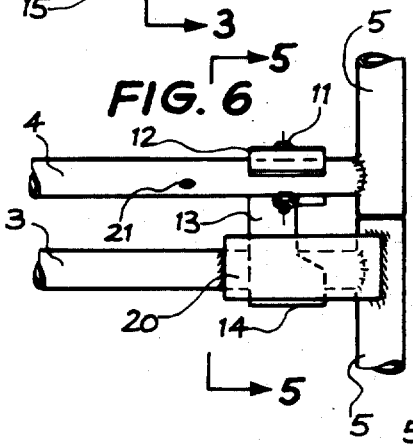
FIG. 6 is a view similar to FIG. 5 from another direction.
Figure 7:
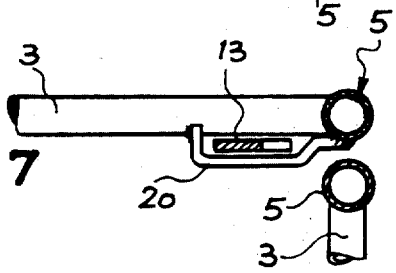
FIG. 7 is a view similar to FIGS. 5 and 6 from yet another direction.

The upper end of each upright 5 and 6 of panel 1 has a bracket 20. One simple form of bracket 20 is shown in FIGS. 5 to 7. Each bracket 20 is adapted to co-operate with a clip when relocated on the rail 4. This is done by removing the bolt 11 from hole 21 (see FIG. 6) and resecuring the clip by inserting the bolt 11 in the hole 22 (see FIG. 4) through the rail 4. The hole 22 lies at a different angle to the hole 21 to the horizontal. See FIGS. 3 and 5 where the angle X (preferably 24°) to the horizontal is less than the angle Y (preferably 48° to the horizontal). The clips 10 are entered into the brackets 20 by inclining the section to be mounted until it takes up the dotted position of FIG. 5 and by then passing the hook 14 between the top rail 3 and the bracket 20, the section is then swung upright to the position shown in full lines in FIG. 5. It will be seen that when so mounted the section cannot be vertically moved due to the clip hook 14 being located beneath the top rail 3.

Figure 8:
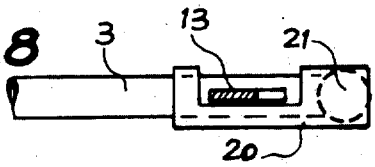
FIG. 8 is a view from above showing a second form of bracket for engaging a clip to mount one cage section on another.

Another form of clip is shown in FIG. 8. The bracket 20 in FIG. 8 has a return leg 21 which covers the top of the uprights 5 and 6 of the panel 1 to provide a surface for the lower ends of the posts 5 and 6 of a superimposed section.

Yet another form of bracket is shown is FIG. 9 which will be seen to have the original bracket part 20, the return leg 21 and also a further upstanding leg 22. From FIGS. 10 and 11 it will be seen how a clip 10 of convenient form will co-operate with the bracket of FIG. 9 and also how the leg 22 serves to centralize a pallet stacked on top of a cage (FIG. 11). Preferably the opening 23 of the leg 21 of the FIG. 9 bracket has upturned raw edges 24 which will tend to bite into the battens of the superimposed pallet to grip the pallet thereby preventing any tendancy for the pallet to move around during transport or movement of a multi-tier pallet or cage assembly.

As previously disclosed pallets are made of international sizes. To transport pallets with cages on an international basis it is desirable to retain the overall size to the international pallet, for this reason the cage should be no larger than the perimeter of the pallet. It is possible however to manufacture a cage according to the invention which positions the cage outside the pallet perimeter. This has the advantage that the whole load surface of the pallet is available for stacking goods whereas previously the area was reduced due to the cage sitting on the pallet surface adjacent the pallet perimeter.

To achieve the above object (see FIGS. 12 to 14) the clips have a body 12, a hook 14 (as before) but a modified leg 25 which has a first part 26 and a crank part 27. Additionally the uprights 5 and 6 are provided at their lower ends with corner plates 28.

Figure 12:
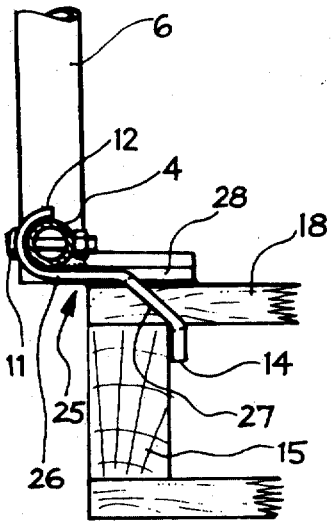
FIG. 12 is a view similar to FIG. 3 showing another form of clip.
Figure 13:
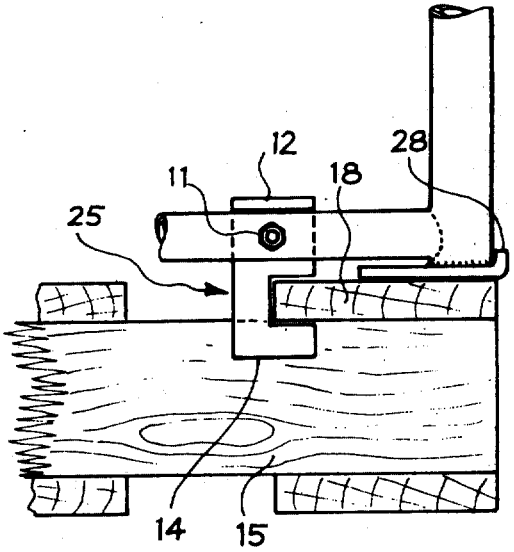
FIG. 13 is a view similar to FIG. 4 showing the clip of FIG. 12.
Figure 14:
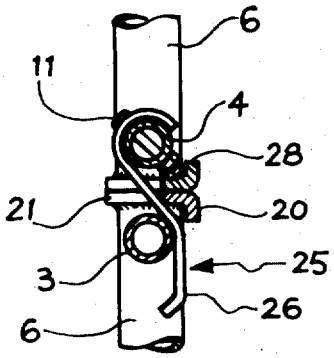
FIG. 14 is a view similar to FIG. 5 showing the clip of FIG. 12.
Figure 15:
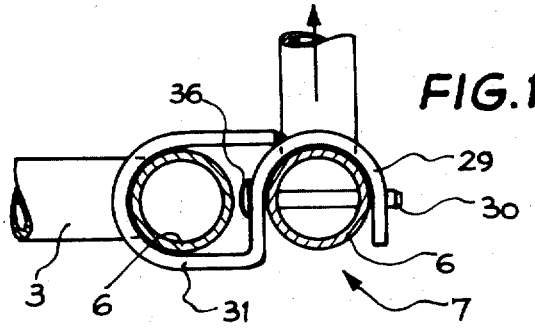
FIG. 15 is a fragmentary view showing the hinge connection between a locking panel and a door panel.
Figure 16:
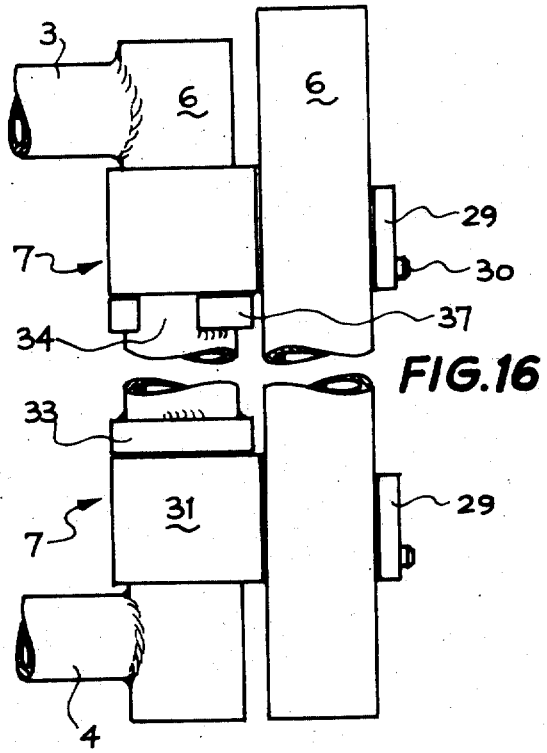
FIG. 16 is an elevation in a first direction showing the hinge connection of FIG. 15.
Figure 17:
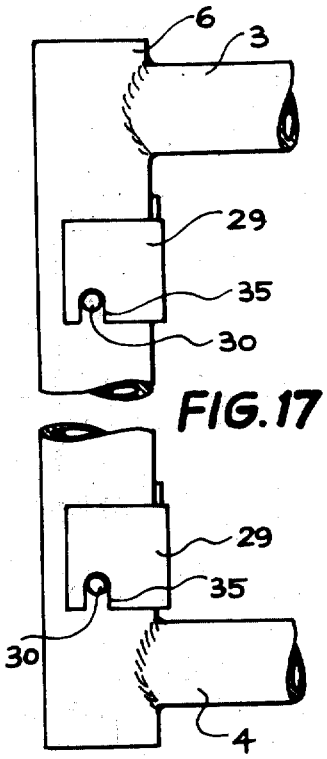
FIG. 17 is a view similar to FIG. 16 from another direction.
Figure 18:
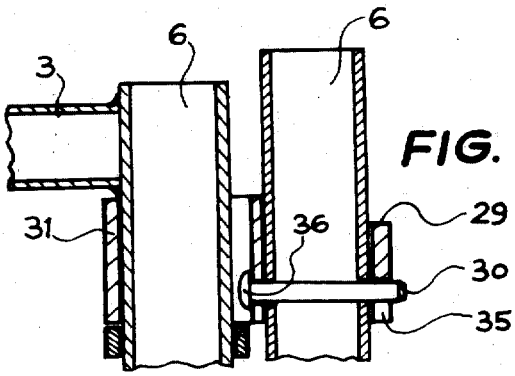
FIG. 18 is a fragmentary view showing detail of the hinge connection of FIG. 15.

From FIGS. 12 and 13 it will be seen how a cage panel 1 fitted with the corner plates 28 and the modified clips will still engage in the desired manner beneath the battens 18 whilst the plate 28 rests on the batten 18. The length of the leg 25 and the angular relationship of the parts 26 and 27 permit the mounting of the cage as shown with the panel 1 outside the perimeter of the pallet. Looking now at FIG. 14 it will be seen that the corner plate 28 will overlie, for example, a bracket as shown in FIG. 8 and the clip would still be engageable in the manner previously described to prevent vertical removal of an upper cage to a lower cage. Again the clip would be relocated by removing the retaining bolts 11, which are horizontal in FIG. 12 and locating them in other holes provided so that the bolts 11 are inclined to the vertical (see FIG. 14) with the crank clip part 26 vertical. A cage so made would co-operate equally well with a cage of the same dimensions which had the simple bracket of FIG. 6 or the bracket of FIG. 9 except that the upturned edge portions 24 of the opening 23 would not be required.

All of the foregoing description has been related to a cage with doors held by simple hinge means as shown in FIG. 1 to the uprights of the fixing panel. It has been found desirable for certain loading and unloading operations to have the door of a cage removable and this is possible using the hinge means illustrated in detail in FIGS. 15 to 18. Specifically the hinge members 7 have a curled body portion 29 to partially encircle the upright 6 of the panel 1. It is held in place by a pin 30. The member 7 has another portion 31 which encircles the upright 6 of the door panel. The members 7 are held in spaced relationship by collars 32 and 33 fixed to the upright 6 of the door panel 2 and the upper collar 32 as a cut-out portion 34 which is located at about 90°-120° to the plane of the panel 2. The other important feature of the hinged connection is that the portion 29 has U cut-outs 35 which engage over the pin 30 and its head 36 (if the head is present).

Under normal circumstances the door can be rotated as it is supported in the portions 31 of the members 7 which are secured against rotation by engagement of the pin 30 in the notch 35. When the door is to be removed it is opened sufficiently to align the cut-out 34 in the collar 32 with the head 36 of the pin 30. The door assembly including the members 7 can then be raised, because the gap 34 is aligned with the head 36 until such time as the notches 35 leave the pin 30 and the head 36. The members 7 can then be uncoupled from the uprights 6 by moving them laterally in the direction of the arrow in FIG. 14. All of the foregoing features can be clearly seen by reference to FIGS. 15 to 18.

Hitherto a cage for a pallet has been considered as always being comprised of four panels. With the foregoing hinged arrangement a cage of three panels (two fixed and a door) can be interlocked with each other and the pallet and because of the clip to batten arrangement of this invention the three sided cage will remain free standing on the pallet. It is clear that such a pallet has an advantage in loading and unloading. After the operation is completed, whether it be loading or unloading, the removed door panel can be simply replaced.

Figure 19:
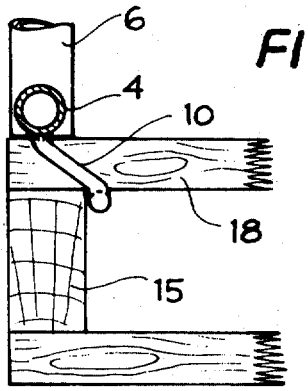
FIG. 19 is a view similar to FIG. 3 showing an alternative form of clip.
Figure 20:
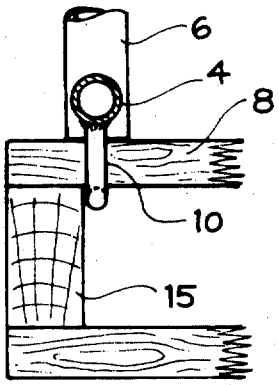
FIG. 20 is a view similar to FIG. 3 showing yet another form of clip.
Figure 21:
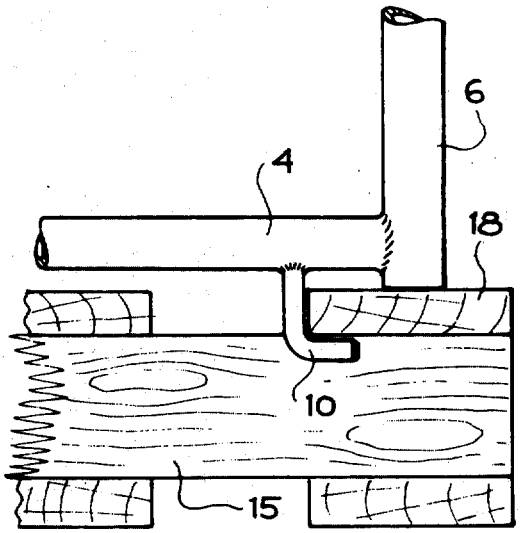
FIG. 21 is a view similar to FIG. 4 showing the use of the clip of FIG. 20.

The foregoing is a description primarily directed to a pallet cage arrangement in which the clips are designed to enable the cage to be added to another cage to make a cage of considerable height. For example a one meter high cage added to another such cage to give a cage of two meter height. The basic clipping arrangement may be designed to simply mount a single two or three meter cage to a pallet. A sketch of modified clip is shown in FIGS. 19 to 21.

Figure 22:
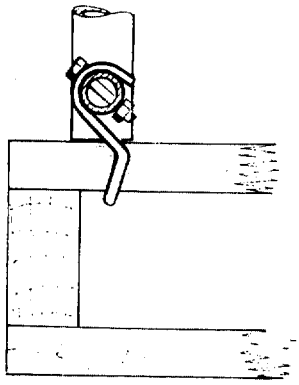
FIG. 22 is a view similar to FIG. 3 showing the use of the clip of FIG. 20.
Figure 23:
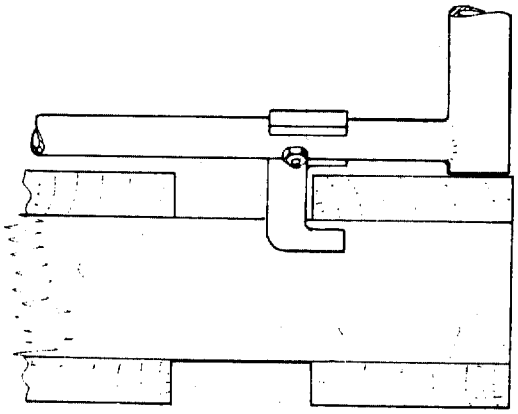
FIG. 23 is a view similar to FIG. 4 showing the use of the clip of FIG. 20.
Figure 24:
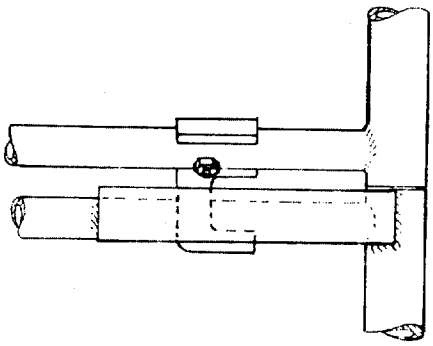
FIG. 24 is a view similar to FIG. 6 showing the use of the clip of FIG. 20.

In FIG. 19 the clip 10 is again of the cranked type to give good pallet loading area and is fixed to rail 4. Looking now at FIGS. 20 and 21 a single position clip 10 giving a reduced load area can be used. Looking now at FIGS. 22 to 24 if a reduced load area is acceptable a single-position clip 10 will enable the cage to be mounted on a pallet, according to the invention, and to also superimpose one cage on another. It is to be noted the clips can be of simple round section and can be permanently mounted on the cage rails at a single position or removably mounted in a single position.

Figure 27:
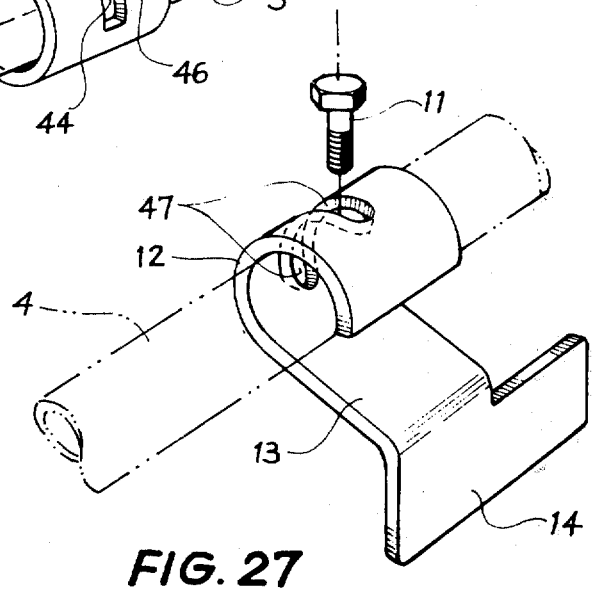
FIG. 27 is a perspective form of yet another clip to mount a cage panel to a pallet or on another cage panel.

The clip embodiment of FIG. 27 is also a practical possibility. It involves a standard clip as for example illustrated in FIGS. 3 to 6, but for single positioning the clip 10 has the body 12 provided with a slot 47 instead of a hole. The bolt 11 is released to allow the clip 10 to partly rotate with the bolt sliding in slot 47 to locate the clip in the portions of FIG. 3 or FIG. 5 and the bolt can then be tightened to secure the clip in the required position.

Figure 25:
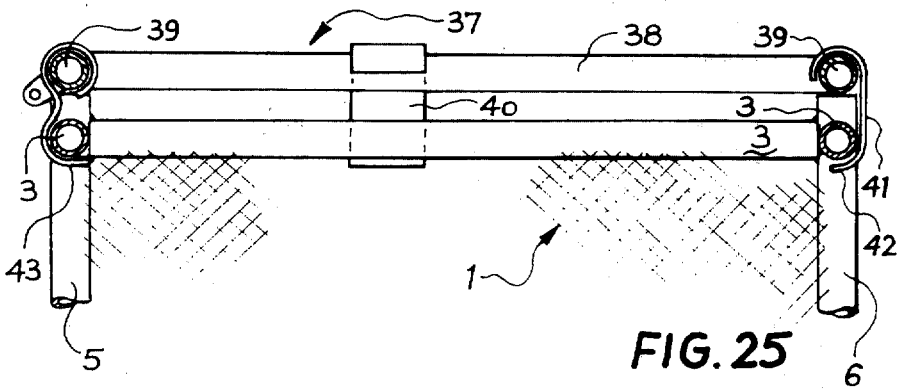
FIG. 25 is a sectional view showing a lid mounted on a cage according to the invention.
Figure 26:
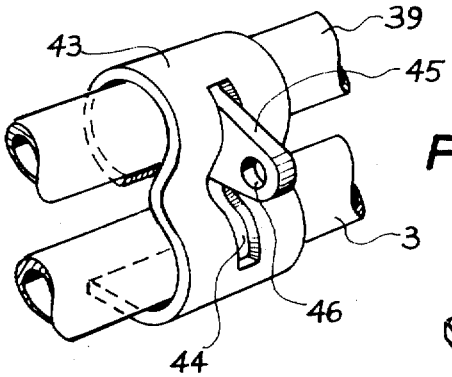
FIG. 26 is a fragmentary perspective view showing the locking arrangement of the lid of FIG. 25.

As an additional feature a lockable lid can be provided to make each cage into a container. In FIG. 25 there is shown a portion of a locking panel 1, two uprights 5 and 6 and top rails 3. A lid 37 comprises a rectangular frame with sides 38—38 and 39—39 has infill material, e.g. wire mesh (not shown). The sides 38 have side locating lugs 40 to which laterally locate against the top rails 3 of panels 1. The sides 39 have either fixed lugs 41 curled as at 42 to engage under top rail 3 of panel 2 or a locking flap 43 pivotally rotatably mounted on top rail 3 of panel 2. The flap 43 has a slot 44 to receive lug 45 fixed to rail 39. The arrangement is similar to a hasp and staple connection (see FIG. 26) and by placing a lock or clip in hole 46 of lug 45 the lid 37 is retained in place on the cage.

I claim:

1. For a goods pallet comprising at least two parallel bearers with battens fixed to opposite top and bottom edges of the bearers and lying transverse to the bearers, the battens fixed to the bottom bearer edges being pallet support battens and the battens fixed to the top bearer edges being load support battens with two of the load support battens constituting parallel cage securing battens; a pallet cage locking panel comprising a pair of uprights joined by top and bottom rails, to define a substantially rectangular frame, a pair of clips on the bottom rail each clip comprising a leg with a hooked end, the clip legs extend in the same direction away from the panel and the hooked ends extend in opposite directions from outer edges of the legs; the spacing between the hooked end of the clips and the rail bottom in a direction parallel to the plane of the panel being not less than the thickness of the cage securing batten; the distance between the outer edges of the legs being not greater than the distance between the cage securing battens; the overall distance between the ends of the hooked ends of the clips exceeding the distance between the cage securing battens but not exceeding the diagonal distance between the intersections of the cage securing battens with adjacent bearers.

2. A pallet cage locking panel as claimed in claim 1 wherein the clips are releasably secured to the bottom rail.

3. A pallet cage locking panel as claimed in claim 1 having a substantially rectangular door panel made up of two uprights joined by top and bottom rails and with one upright hingedly connected to one of said locking panel uprights to form a locking panel—door panel assembly, the other door and locking panel uprights having complementing half coupling members thereon engageable with like complementing half coupling members on the corresponding uprights of a locking panel—door panel assembly whereby two such assemblies can be connected together to form a four sided cage for a pallet.

4. A pallet cage locking panel as claimed in claim 3 wherein the door panel is removably hingedly connected to the locking panel.

5. A pallet cage locking panel as claimed in claim 4 wherein the hinged connection comprises hinge members each rotatably mounted on the said one door panel upright and each including a saddle member to partially embrace said one upright of the locking panel and slidably engage in a door mounting operation over a locating pin thereon when a portion of one pin is aligned with and passed through a slot across a collar fixed to said one upright of said door panel.

6. A pallet cage locking panel as claimed in claim 1 including a bracket at each upper corner where the uprights engage the top rail, each bracket having a portion spaced laterally from the locking panel top rail so as to provide an opening between that portion and the top rail to receive the hooked leg of a clip, said hook being in a plane angled to the plane of the clip leg and being mounted so that said hook lies below the panel bottom rail in the plane of the locking panel on which it is mounted.

7. A pallet cage locking panel as claimed in claim 6 wherein the brackets include portions which cover adjacent upper corners of the cage.

8. A pallet cage locking panel as claimed in claim 7 wherein the brackets also include upstanding portions to align a pallet superimposed on a cage with the pallet on which said cage is mounted.

* * * * *